US009028209B2

(12) United States Patent
Liang et al.

(10) Patent No.: US 9,028,209 B2
(45) Date of Patent: May 12, 2015

(54) PIPELINE PUMP SHAPED BY STAMPING AND WELDING

(75) Inventors: Yuanmin Liang, Yangjiang (CN); Guolong Chen, Yangjiang (CN); Fuhui Zhong, Yangjiang (CN); Hongqi Ren, Yangjiang (CN); Dongxian Liang, Yangjiang (CN); Chunyuan Huo, Yangjiang (CN)

(73) Assignee: Guangdong Winning Pumps Industrial Co., Ltd., Yangjiang, Guangdong (CN)

( * ) Notice: Subject to any disclaimer, the term of this patent is extended or adjusted under 35 U.S.C. 154(b) by 596 days.

(21) Appl. No.: 13/503,404

(22) PCT Filed: Oct. 14, 2010

(86) PCT No.: PCT/CN2010/077724
§ 371 (c)(1),
(2), (4) Date: Apr. 23, 2012

(87) PCT Pub. No.: WO2011/047602
PCT Pub. Date: Apr. 28, 2011

(65) Prior Publication Data

US 2012/0219406 A1 Aug. 30, 2012

(30) Foreign Application Priority Data

Oct. 23, 2009 (CN) ..... 2009 1 0308753

(51) Int. Cl.
*F03B 11/02* (2006.01)
*F04D 29/42* (2006.01)
*F04D 29/62* (2006.01)

(52) U.S. Cl.
CPC ..... *F04D 29/4266* (2013.01); *F04D 29/628* (2013.01)

(58) Field of Classification Search
USPC ..... 415/110, 113, 182.1, 208.3, 211.2
See application file for complete search history.

(56) References Cited

U.S. PATENT DOCUMENTS 7,223,070 B2 * 5/2007 Tam et al. ..... 415/208.3

FOREIGN PATENT DOCUMENTS

| | | | |
|---|---|---|---|
| CN | 1629496 | A | 6/2005 |
| CN | 201187455 | Y | 1/2009 |
| CN | 201310493 | Y | 9/2009 |
| CN | 101749275 | A | 6/2010 |
| CN | 201535256 | U | 7/2010 |

* cited by examiner

*Primary Examiner* — Edward Look
*Assistant Examiner* — Aaron R Eastman
(74) *Attorney, Agent, or Firm* — Buchanan Ingersoll & Rooney PC

(57) ABSTRACT

A pipeline pump shaped by stamping and welding, comprises a pump body, a pedestal, a pump rear cover and a motor installed at the opening of the pump body, and an impeller arranged inside the pump body. The pump body is comprised of an inner cylinder and an outer cylinder. A flow guide part, the impeller, an exhaust part, and the pump rear cover mounted on the opening of the outer cylinder are coaxially arranged upwards in turn from the opening of the inner cylinder. The impeller is axial suction and radial discharge. The disk bottom of the flow guide part is sealed with the opening of the inner cylinder. The impeller is coaxially arranged inside the flow guide part, and a flow guide vanes corresponding to a radial exhaust port of the impeller are provided on a circumferential wall of the flow guide part.

10 Claims, 10 Drawing Sheets

PIPELINE PUMP SHAPED BY STAMPING AND WELDING

CROSS-REFERENCE TO RELATED APPLICATIONS

This application is the U.S. national phase application of PCT International Application No. PCT/CN2010/077724, filed on Oct. 14, 2010, which claims priority to China Patent Application No. CN 200910308753.8, filed on Oct. 23, 2009. The above application(s) is hereby incorporated herein by reference.

STATEMENT REGARDING FEDERALLY SPONSORED RESEARCH OR DEVELOPMENT

None

FIELD OF THE INVENTION

The present invention relates to a centrifugal pump, particularly to a pipeline type single-stage centrifugal pump with an overflow part totally shaped by stamping and welding, i.e. pipeline pump shaped by stamping and welding.

BACKGROUND OF THE INVENTION

Typically there are many shortcomings for traditional pipeline pumps: Almost all the pipeline pumps are shaped by casting, characterized with complicated structure of overflow part, cumbersome products and heavy consumption of materials. The hydraulic performance of the pumps is not desirable, and the pumps are working in part load with low efficiency. In addition, the casting process pollutes environment; for the overflow part of pipeline-type multi-stage centrifugal pump with small flow rate and high pumping head, it is difficult to cast due to the existence of the narrow and long overflow channels in many parts of the pump, such as the impeller and flow guide vane.

In view of that, the present invention is hereby proposed.

SUMMARY OF THE INVENTION

The object for the present invention is to overcome the shortcomings of the traditional pipeline pump, and therefore provided is a pipeline pump with an overflow part all shaped by stamping and welding.

To solve the above technical problems, we use the basic technical scheme as follows: a pipeline pump shaped by stamping and welding, including a pump body, a pedestal installed on the bottom of the pump body, a pump rear cover and a motor mounted on the opening of the pump body, and an impeller installed inside the pump body, the impeller being installed on a pump shaft and driven for rotation by the motor, a water inlet pipe and a water outlet pipe being provided on the pump body, wherein: the pump body consists of an inner cylinder and an outer cylinder both in barrel-shaped structure, of which the inner cylinder is connected to the water inlet pipe, and the outer cylinder is connected to the water outlet pipe, the inner cylinder is coaxially installed inside the outer cylinder by fixedly connecting the bottom of the inner cylinder with the bottom of the outer cylinder, the opening of the inner cylinder is lower than the opening of the outer cylinder, a flow guide part, the impeller, an exhaust part, and the pump rear cover mounted on the opening of the outer cylinder is coaxially arranged upwards in turn from the opening of the inner cylinder, the impeller is a centrifugal impeller with axial suction and radial discharge, the flow guide part is a disk-shaped structure shaped by integral stamping with the disk bottom being sealed with the opening of the inner cylinder, and a water inlet which is correspondingly sealed with an inlet at the front end of the impeller being provided on the center of the disk bottom, and the impeller is coaxially arranged inside the flow guide part with a shape of disk, and flow guide vanes which are corresponding to a radial exhaust port of the impeller is provided on a circumferential wall of the flow guide part, the impeller consists of a front cover plate, a back cover plate and a spiral vane clipped between the front cover plate and the back cover plate, the spiral vane being in semi-twisting structure including a twisted section on the end close to the water inlet and a section with non-twisted cylindrical structure on the end close to the exhaust port, twist rate being the biggest at the place close to the water inlet, and being gradually flat, the section close to the exhaust port being not twisted, and a connection between the two sections being smoothly transited.

The twisted section of the vane is approximately a section of truncated cone, while the section with non-twisted cylindrical structure of the vane is a section of truncated cylindrical lateral face and accounts for ⅕~½ of the total length of the vane, the width in axial direction of the twisted section of the vane is maximum at the water inlet, and gradually narrows to the width of the section with non-twisted cylindrical structure, the structures of the two sections of the vane are internally tangent with each other.

The twist rate of the vane is related to the specific speed of the pipeline pump, the greater the specific speed, the greater the twist rate, and the smaller the length of the section with non-twisted cylindrical structure.

The circumferential wall of the flow guide part is uniformly stamped into multiple sections, and each section of the circumferential wall is an arc-shaped guide vane whose area is increased outward in radial direction along the same direction of the circumference, and an outlet is axially downward formed by the radial difference between two adjacent guide vanes, and a disk rim is formed by outward stamping at an opening of the flow guide part with a shape of disk. The arc distribution of the arc-shaped flow guide vane corresponds to the rotation direction of the impeller, to improve the water output efficiency.

A boss club corresponding to the disk rim of the flow guide part is provided on the internal wall of the outer cylinder, the disk rim is placed on the boss club to support the flow guide part, and the axial distance between the boss club and the opening of the inner cylinder is equal to the axial depth of the flow guide parts.

The boss club refers to a convex table on the circumferential wall of the outer cylinder.

The exhaust part is a disk-shaped structure shaped by stamping, the disk bottom encloses the impeller in the flow guide part, the radius of the disk bottom is greater than that of the circumferential wall of the disk, an opening corresponds to the pump rear cover, the pump shaft passes through the motor, the pump rear cover, the exhaust part in turn and reaches the impeller, a water port is installed between the disk bottom and the pump shaft, and a water hole is uniformly provided on the circumferential wall of the exhaust part, and annular cavity is formed between the circumferential wall of the exhaust part and the inner wall of the outer cylinder, and an exhaust vent connecting outside and the annular cavity, a seal ring and a bolt are provided on the outer cylinder.

Alternately, the exhaust part and the pump rear cover are simplified into one part which is stamped into a disk-shaped structure, wherein, the disk bottom encloses the impeller in the flow guide part, and the center of the disk bottom bulges towards the inside of the disk, forming a trumpet-shaped structure, and an exhaust vent, a seal ring and a bolt are provided on the circumferential wall of the trumpet-shaped structure.

A convex rib is set on the part of the outside wall of the outer cylinder being passed through by the water inlet pipe and the water outlet pipe, a support of the water inlet pipe and a support of the water outlet pipe are fixed on the convex rib to support the water inlet pipe and the outlet pipe, and the structure of the convex rib is used to enhance the strength of the outer cylinder. The connection surfaces of the supports of the water inlet pipe and the water outlet pipe and the convex rib are planes, to facilitate the connection between the supports of the water inlet pipe and the water outlet pipe and the convex rib.

The front cover plate, the back cover plate and the spiral vane are all shaped by stamping of metal plates, which are combined by using laser welding to guarantee a secure connection of the front cover plate, the back cover plate and the vane. The front cover plate integrally consists of a front plate and an annular flange being processed and shaped by stamping process, a processing arc lies between the front plate and the annular flange, and a seal ring sealing the disk bottom of the flow guide part and the inlet of the impeller is set on the front end of the annular flange, the seal ring matches with the front end of the annular flange, and a gap is set between the front plate of the front cover plate of the impeller and the seal ring.

An inclination is formed by stamping process of the annular flange, and is in shape of a trumpet structure with gradually increased outside diameter from the inlet of the impeller to the inner, among which the diameter is the smallest in the section close to the water inlet of the flow guide part, and gradually becomes large in direction of the front plate, and finally connects with the front plate through processing arc, wherein, the processing arc is tangent to the front plate and the annular flange respectively, the external diameter at the place where the processing arc is tangent to the front plate is greater than the internal diameter of the seal ring.

Drain holes, seal rings and screws of the outer cylinder and the inner cylinder are provided on the circumferential wall and the bottom of the outer cylinder respectively, by which the water in the inner cylinder can be emptied, which is different from the filling drain hole common to inner and outer cylinders adopted in the prior art.

The overflow parts for the pipeline pump in present invention are all shaped by stamping and welding, such as the pump body, the outer cylinder, and the inner cylinder, the flow guide part, the pedestal, and the pump rear cover.

In view of the above mentioned technical scheme, the present invention has the following beneficial effects compared with prior art.

1. All the overflow parts, e.g. the pedestal, the pump body, the flow guide part and the impeller etc., are shaped by stamping and welding, and therefore there are advantages such as handy overall structure, greatly reduced weight and obvious effect on material saving compared with the casting pump; and the reliability of a water pump in operation is significantly improved;

2. Flow guide method of radial exhaust from impeller is used, and the flow guide part is under measures such as special design to obtain more smoothly convey liquid flow, have good hydraulic performance and higher efficiency;

3. Compared with the existing stamping pumps, the flow guide part with an integrated stamping structure guarantees the adequate strength, rigidity and precision and convenient installation of the flow guide part, improves the reliability of the product and extends the service life of the products;

4. It is good sealing effect, and to improve the hydraulic efficiency of the pump; but also to lower the difficulty in manufacture and installation, and to improve the production efficiency that an active seal structure for seal ring is adopted at the inlet of the impeller;

5. The water in the inner cylinder can be emptied through the drain hole, the seal ring and the screw for outer cylinder and inner cylinder being respectively provided on the circumferential wall and bottom of the outer cylinder.

The specific embodiments of the invention are further described hereunder in detail in combination with the accompanying drawings.

DETAILED DESCRIPTION

Figure 1:
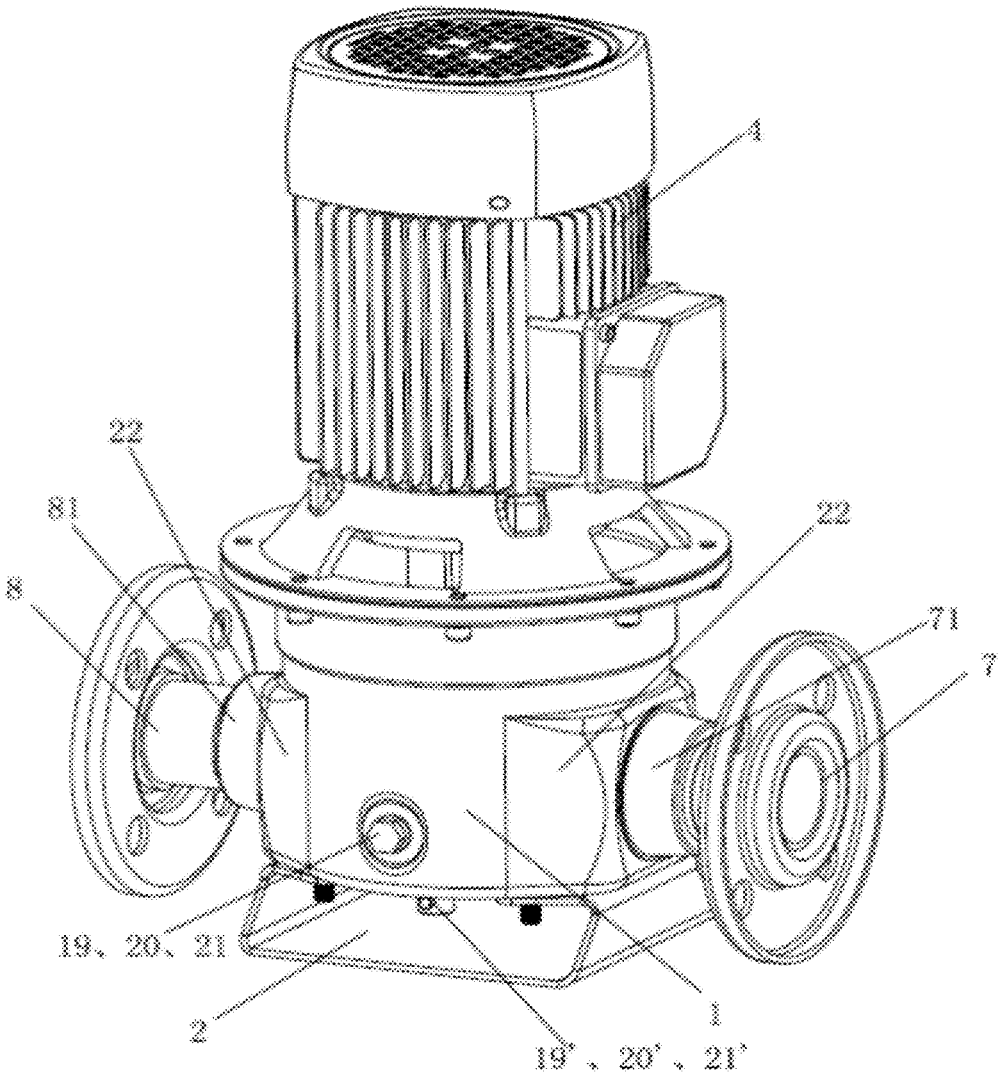
FIG. 1 illustrates an embodiment of the pipeline centrifugal pump shaped by stamping and welding in accordance with the present invention.
Figure 2:
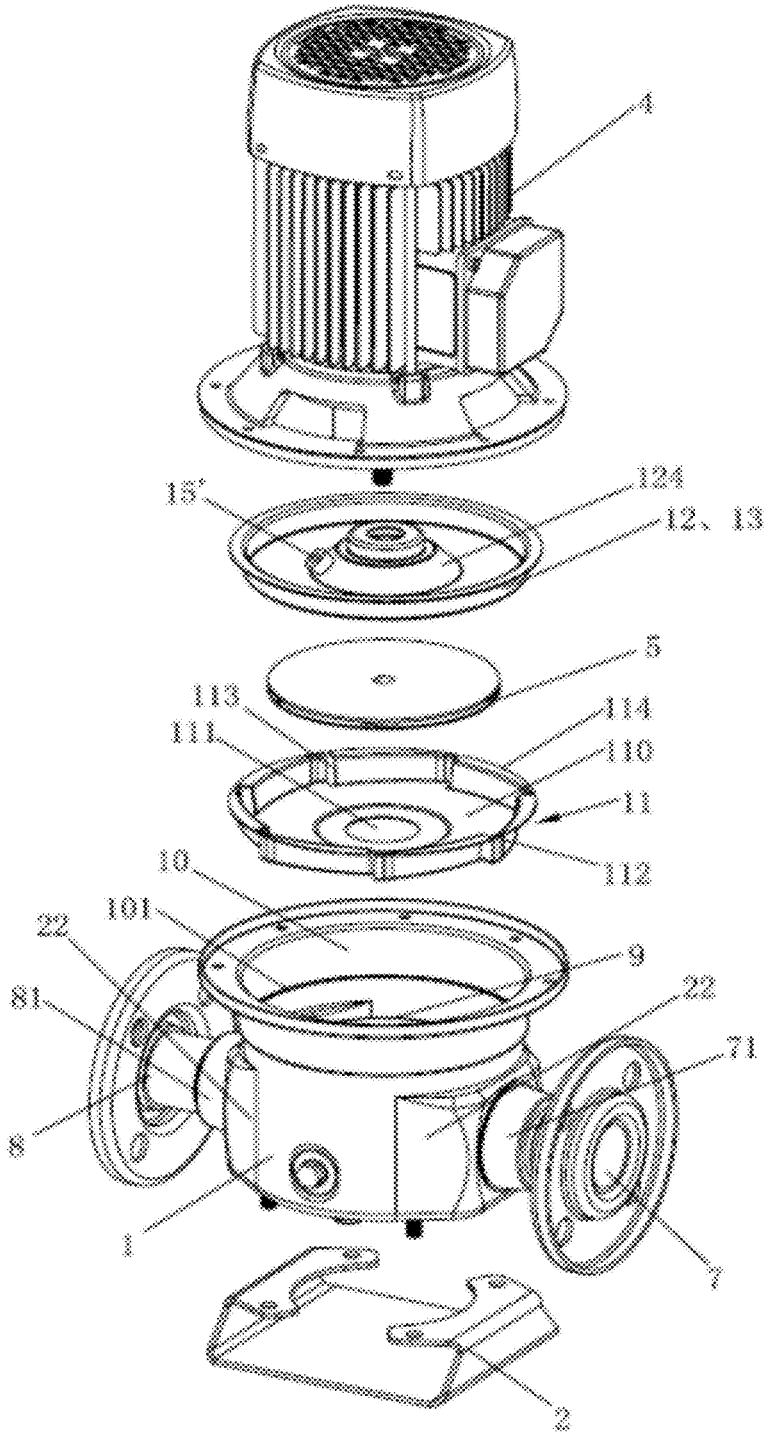
FIG. 2 illustrates the assembly of pipeline centrifugal pump shaped by stamping and welding in accordance with the present invention.

As shown in FIG. 1 and FIG. 2, a pipeline centrifugal pump shaped by stamping and welding in the invention, comprises a pump body 1, a pedestal 2 connected with the bottom of the pump body 1, a pump rear cover 13 and a motor 4 mounted at an opening of the pump body 1, and an impeller 5 installed inside the pump body 1. The impeller 5 is mounted on a pump shaft 6 and driven by the motor 4. A water inlet pipe 7 and a water outlet pipe 8 are connected to the pump body 1. The pump body 1 is composed of an inner cylinder 9 and an outer cylinder 10 both in barrel-shaped structure; the inner cylinder 9 is connected with the water inlet pipe 7, whereas the outer cylinder 10 is connected with the water outlet pipe 8. The inner cylinder 9 is coaxially installed inside the outer cylinder 10 in this way: the bottom of the inner cylinder 9 is fixedly connecting with the bottom of the outer cylinder 10. The opening of the inner cylinder 9 is lower than the opening of the outer cylinder 10. A flow guide part 11, the impeller 5, an exhaust part 12 and the pump rear cover 13 mounted on the opening of the outer cylinder 10 are coaxially arranged upwards in turn from the opening of the inner cylinder 9. The impeller 5 is a centrifugal impeller with axial suction and radial discharge. The flow guide part 11 is a disk-shaped structure shaped by integral stamping. A disk bottom 110 is sealed with the opening of the inner cylinder 9. A water inlet 111 which is correspondingly sealed with an inlet at the front end of the impeller 5 is provided on the center of the disk bottom 110. The impeller 5 is coaxially arranged in the flow guide part 11 with a shape of disk. A flow guide vane 112 which corresponds to a radial exhaust port of the impeller 5 and communicates with the outer cylinder 10 is provided on the circumferential wall of the flow guide part 11.

Figure 3:
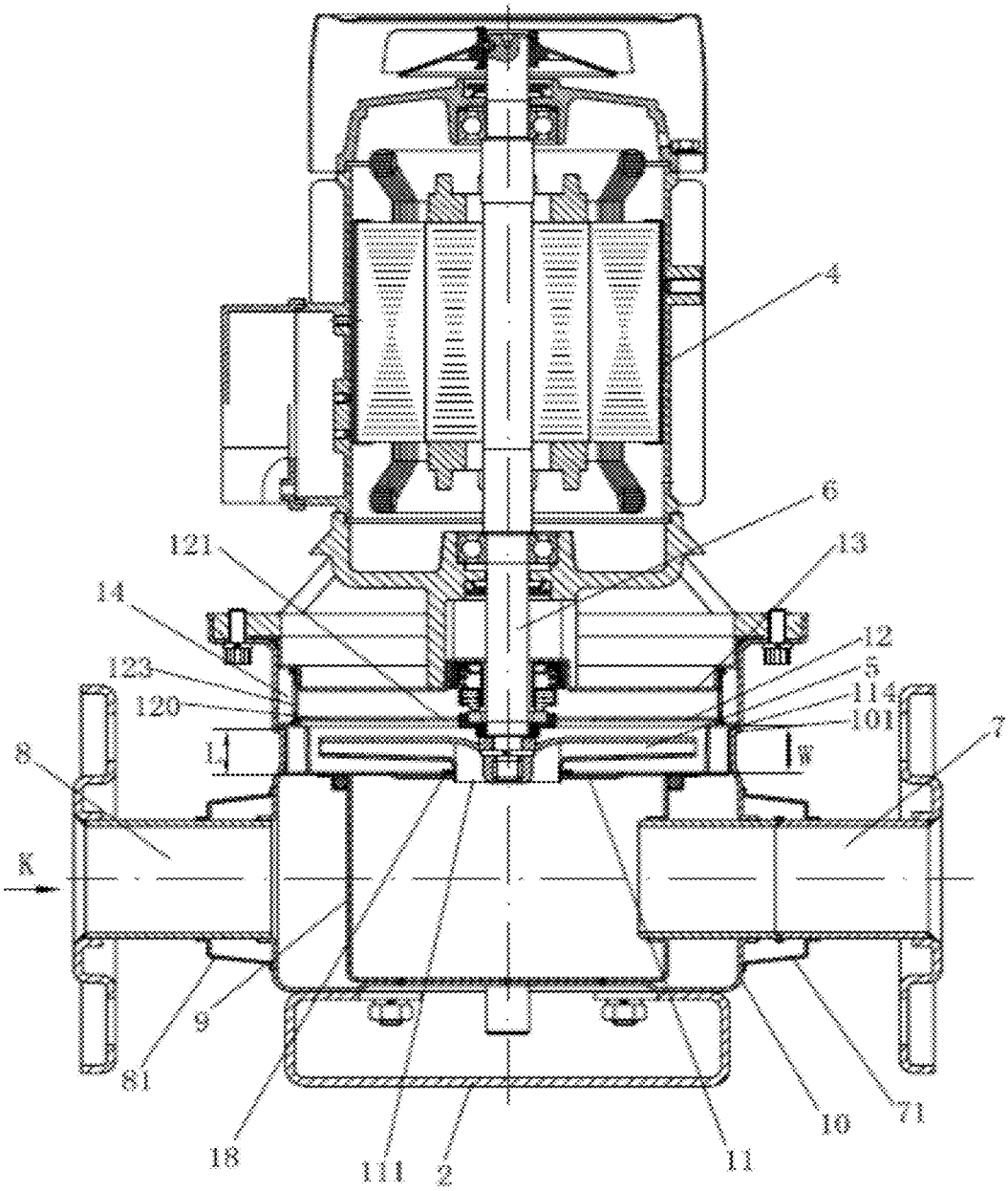
FIG. 3 shows a cross-section view for the pipeline centrifugal pump shaped by stamping and welding in accordance with the present invention.
Figure 11:
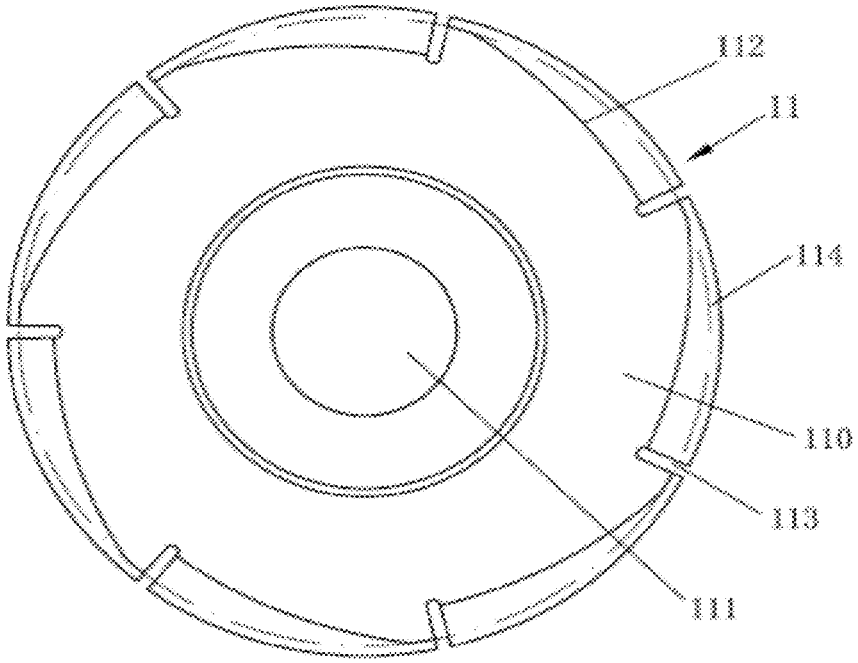
FIG. 11 illustrates the flow guide part in accordance with the present invention.

As shown in FIG. 2 and FIG. 11, the circumferential wall of the said flow guide part 11 is uniformly stamped into multiple sections, and each section of the circumferential wall is arc-shaped guide vane 112 whose area is increased outward in radial direction along the same direction of the circumference. An outlet 113 is axially downward formed into by the radial difference between two adjacent guide vanes 112, and a disk rim 114 is formed by outward stamping an opening of the flow guide part 11 with a shape of disk. The arc distribution of the arc-shaped flow guide vane corresponds to the rotation direction of the impeller, to improve the water output efficiency. A boss club 101 corresponding to the disk rim 114 of the flow guide part is provided on the internal wall of the outer cylinder 10, and the disk rim 114 is placed on the boss club 101 to support the flow guide part 11, and the axial distance L between the boss club 101 and the opening of the inner cylinder 9 is equal to the axial depth W of the flow guide part (as shown in FIG. 3). The boss club 101 is a convex table of the circumferential wall of the outer cylinder.

Figure 12:
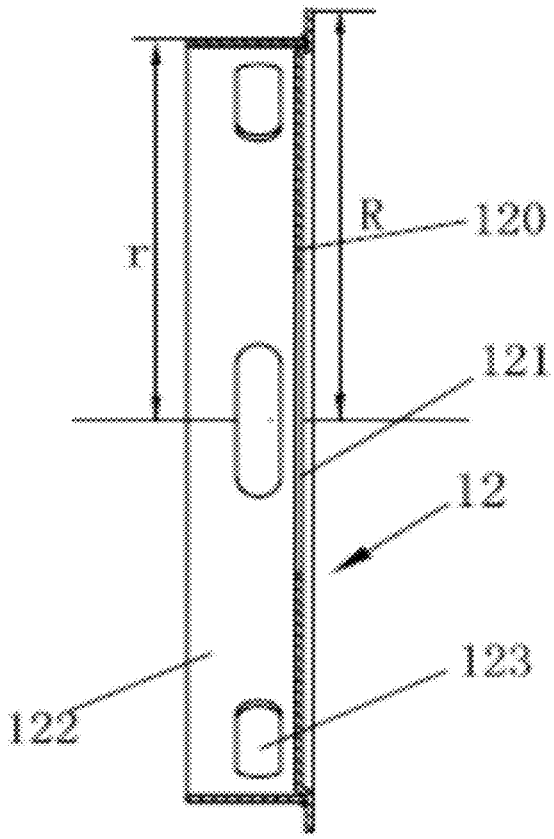
FIG. 12 illustrates a type of exhaust part in accordance with the present invention.

As shown in FIG. 3 and FIG. 12, the exhaust part 12 is a disk-shaped structure shaped by stamping, the bottom 120 of the disk encloses the impeller 5 in the flow guide part 11, and the radius R of the bottom of the disk is greater than the radius r of the circumferential wall of the disk. An opening corresponds to the pump rear cover 13, and the pump shaft 6 pass through the motor 4, the pump rear cover 13, the exhaust part 12 in turn and reaches the impeller 5, and a water port 121 is installed between the bottom 120 of the disk and the pump shaft 6. A water hole 123 is uniformly provided on the circumferential wall 122 of the exhaust part, and an annular cavity 14 is formed between the circumferential wall 122 of the disk and an exhaust vent 15 connecting outside and the annular cavity, a seal ring 16 and a bolt 17 are provided on the outer cylinder 10.

Figure 4:
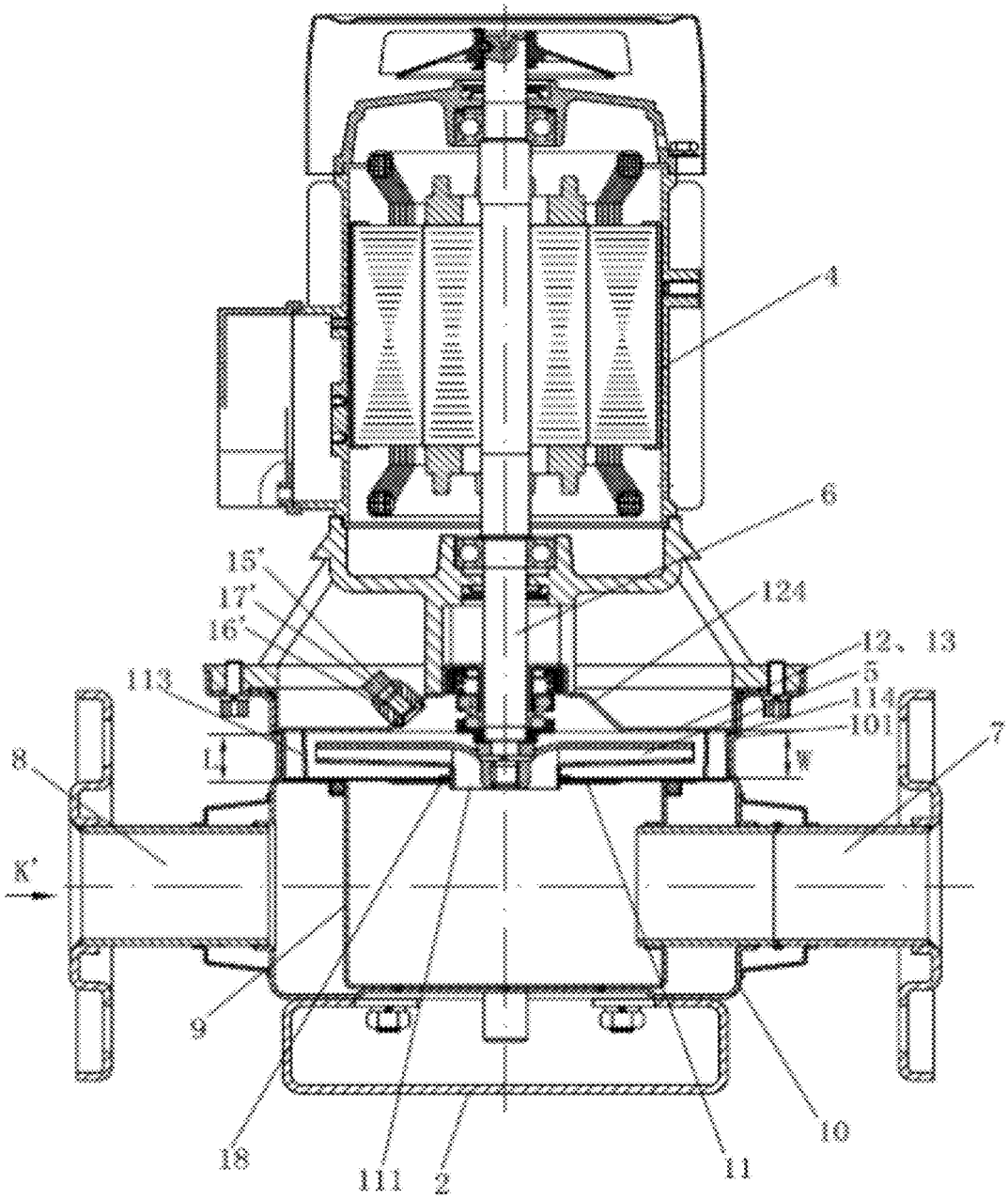
FIG. 4 shows a cross-section view of the pipeline centrifugal pump shaped by stamping and welding in accordance with the present invention.

Alternately, as shown in FIG. 4, the exhaust part 12 and the pump rear cover 13 are simplified into one part, and the exhaust part is stamped into a disk structure, wherein, the bottom 120 of the disk encloses the impeller in the flow guide part, and the center of the bottom of the disk bulges towards the inside of disk, forming into a trumpet-shaped structure 124. An exhaust vent 15', a seal ring 16' and a bolt 17' are provided on the circumferential wall of the trumpet-shaped structure.

As shown in FIG. 1 and FIG. 2, a convex rib 22 is set on the part of the outside wall of the said outer cylinder 10 being passed through by the water inlet pipe 7 and the water outlet pipe 8, and a support 71 of the water inlet pipe and a support 81 of the water outlet pipe are fixed on the convex rib 22 to support the water inlet pipe 7 and the water outlet pipe 8 respectively. The support 71 of the water inlet pipe and the support 81 of the water outlet pipe are fixed on the convex rib 22, and the connection surfaces of the support 71 of the water inlet pipe and the support 81 of the water outlet pipe and the convex rib 22 are planes (as shown in FIG. 3).

Figure 7:
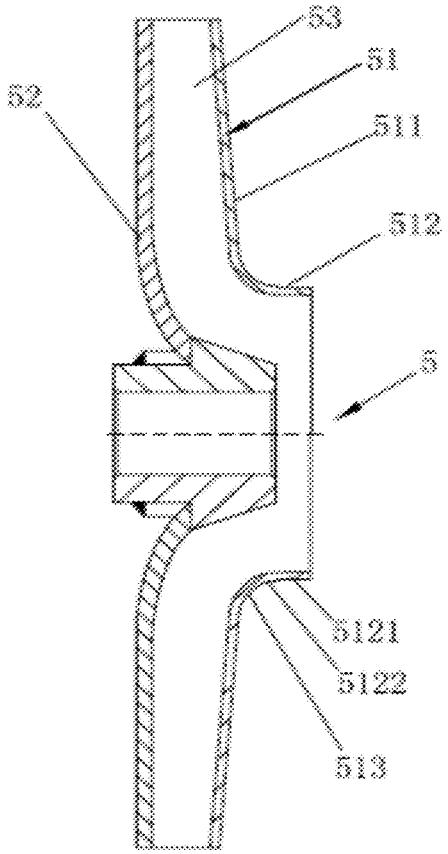
FIG. 7 illustrates the impeller in accordance with the present invention.
Figure 8:
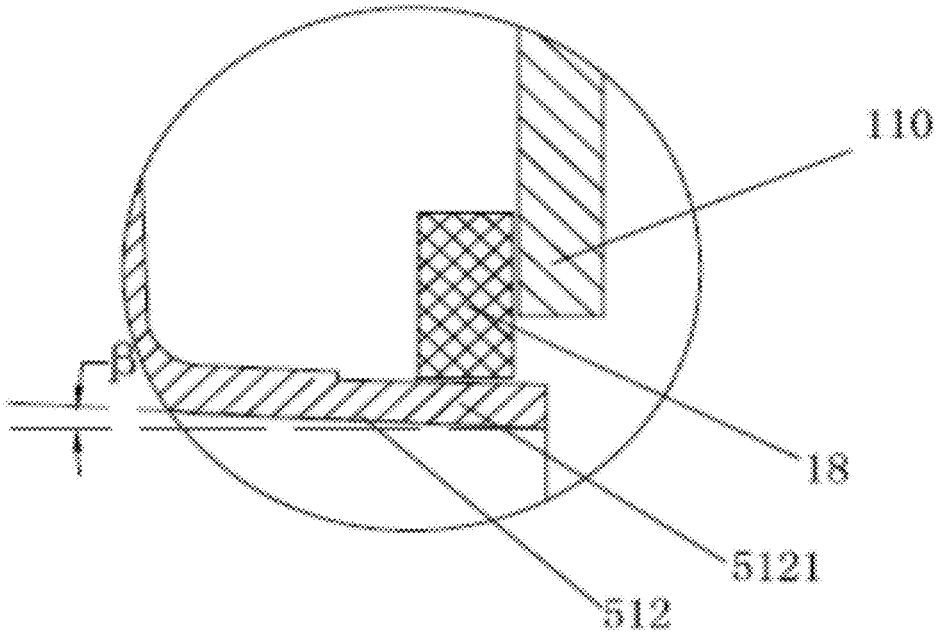
FIG. 8 illustrates a local sketch of the seal structure of the inlet of the impeller.

The impeller 5 consists of a front cover plate 51, a back cover plate 52 and a spiral vane 53 held between the front cover plate and the back cover plate. The front cover plate 51, the back cover plate 52 and the spiral vane 53 are all shaped by stamping of metal plates, which are combined by using laser welding. The front cover plate 51 consists integrally of a front plate 511 and an annular flange 512 processed and shaped by stamping process, and a processing arc 513 lies between the front plate 511 and the annular flange 512. As shown in FIG. 7, the annular flange 512 is formed at the inlet of the front cover plate 51 due to the draft angle generated by the stamping process, and is in shape of a trumpet structure with outside gradually increased diameter from the inlet of the impeller to the inner due to the draft angle from the stamping process. As shown in FIG. 8, the trumpet-shaped annular flange 512 is in inclination angle of β at the inlet of the front cover plate 51 of the impeller, and the annular flange 512 consists of two parts, which comprises the front section 5121 close to the disk bottom 110 of the flow guide part, with the smallest diameter, and then a transition section 5122 with diameter gradually increasing, which is finally connected with the front plate 511 through the processing arc 513. The processing arc 513 is tangent respectively to the front plate 511 and the annular flange 512, and an external diameter at the place where the processing arc 513 is tangent to the front plate 511 is greater than the internal diameter of the seal ring 18. The seal ring 18 is encased on the front section 5121 (as shown in FIG. 8).

Figure 9:
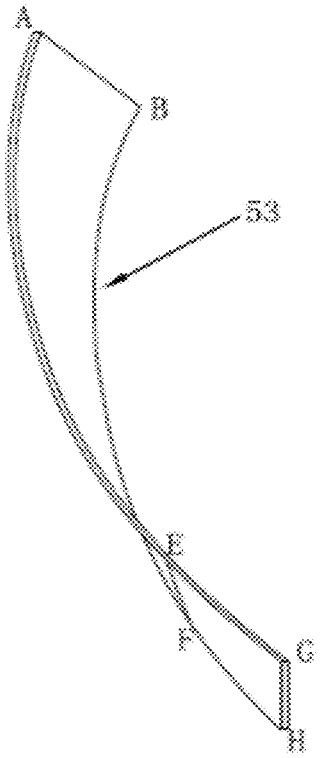
FIG. 9 illustrates the spiral vane in accordance with the present invention.

As shown in FIG. 9, the spiral vane 53 in the embodiment of the invention is a semi-twisting structure, i.e. a twisted section on the end close to the water inlet (i.e. the AB-EF section in the figure) and a section with non-twisted truncated cylindrical structure on the end close to the exhaust port (i.e. the EF-GH section in the figure), the twist rate is the greatest at the place close to the water inlet and gradually becomes flat, and the section close to the exhaust port is not twisted. A connection between the two sections is smoothly transited, among which the maximum twist rate is ±8°.

Figure 10:
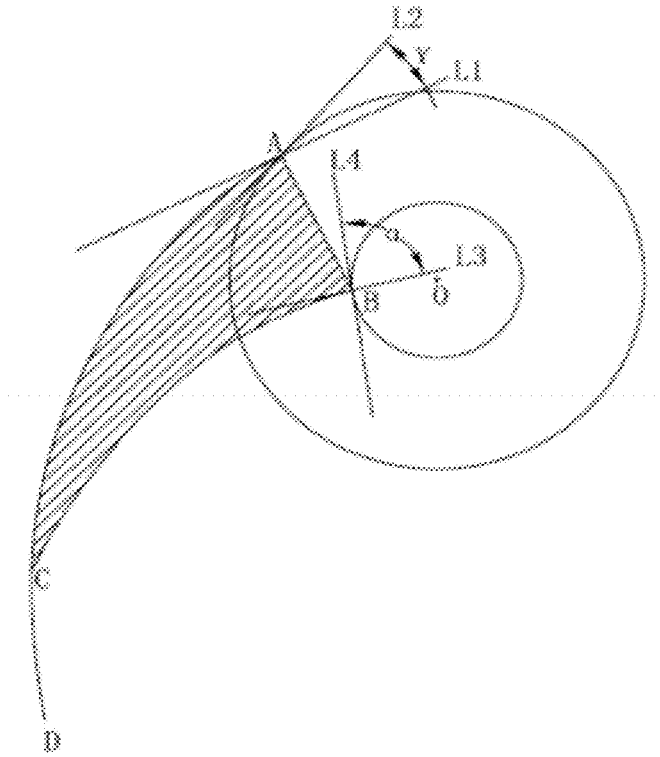
FIG. 10 illustrates the relationship between axial projection and twist for the spiral vane in accordance with the present invention.

The vane 53 is connected with the front cover plate and the rear cover plate by laser welding, of which either end has two connection points for connecting with the front cover plate and the rear cover plates. As shown in FIG. 10, the figure shows the axial projection of the spiral vane, of which the shadowed part ABC is the twisted section; and the curve part CD is the untwisted section, therefore its projection remains a curve. An end of the water inlet connects at point A with the front cover plate, and at point B with the rear cover plate. An included angle γ between the tangent line L1 of the spiral curve of the vane at connection point A and the circumferential tangent line L2 of the pipeline pump is an inlet angle, and an included angle α between the tangent line L3 of the spiral curve of the vane at connection point B and the circumferential tangent line L4 of the pipeline pump is the inlet angle. The difference between the inlet angles of connection point A and connection point B represents a twist of the end. The same inlet angles represent non-twisting of the end, in other words, when the projection of the two connection points on the other end of the vane is one point, there is definitely no twist.

The twisted section of the vane is approximately a section of truncated cone, i.e. a part of the approximately truncated conical lateral face. The axial projection of the approximate part of conical lateral face consists of the curve of different arcs (i.e. the shadowed part ABC in FIG. 10). The cylindrical structure with non-twisted vane is a section of truncated cylindrical lateral face, accounting for ⅕~½ of the total length of the vane. The twisted section of the vane is axially the widest at the water inlet (i.e. the length of AB in FIG. 10), and gradually narrows to the width of the non-twisted cylindrical structure (i.e. the lengths of EF and GH in FIG. 9). The two sections of the vane are internal tangent and connected each other, and the connection line EF is axially inclined.

The twist rate of the vane is related to the specific speed of the pipeline pump. The greater the specific speed is, the greater the twist rate is, and the smaller the length of one section of untwisted cylindrical structure of the vane is.

The front section 5121 of the annular flange 512 closing to the bottom disk 110 of the flow guide part matches with the internal diameter periphery of the seal ring 18. The difference between the internal diameter of the seal ring 18 and the external diameter of the front section 5121 of the annular flange is 0.15~0.30 mm, while a gap exists between the seal ring 18 and the front plate 511 due to the draft angle and the processing arc structure. Due to the action of the interstitial water flow pressure, the seal ring 18 can axially move towards the bottom disk 110 of the flow guide part on the front section 5121 during operating, and clings to the bottom disk 110 of the flow guide part to form into end seal.

The seal ring 18 is in ring shape, of which the difference between internal and external diameters is 3~8 mm, and matches with the bottom disk 110 of the flow guide part to form into end seal (as shown in FIG. 8). As there are draft angle and processing arc on the front cover plate 51 of the impeller, the seal ring 18 can not move to one side of the front plate 511 and a gap is left between the seal ring 18 and the front plate 511. Due to this gap, the seal ring 18 is pushed by water to move forward and attach closely with the bottom disk 110 of flow guide part under high pressure during operation of water pump.

The material of the seal ring is the engineering plastics with relatively good strength and rigidity. A plurality gaps with the spacing of 0.1 mm is formed on the radial separation between the internal diameter and the external diameter at any place on the seal ring. Such a structure will not influence the sealing effects, while can balance the pressure fluctuation between the inner and outer rings of the seal ring caused by run-out of the impeller, to reduce the radial movement between the seal ring and the inlet of the impeller, and avoid the friction between the seal ring and the front cover plate of the impeller and the noises generated during work.

Figure 5:
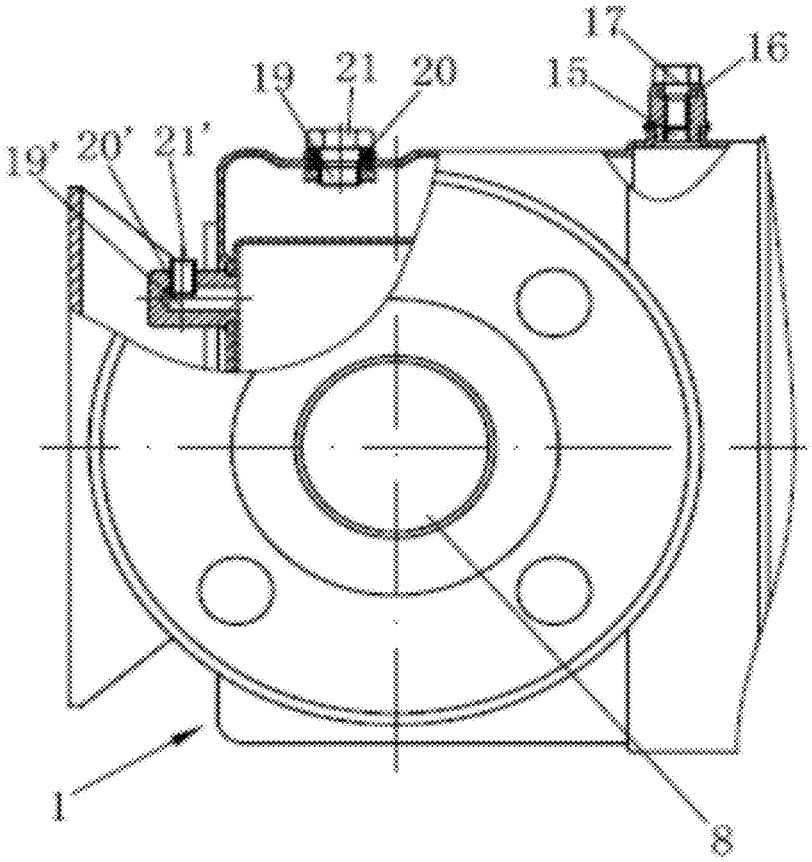
FIG. 5 illustrates a K direction of FIG. 3.
Figure 6:
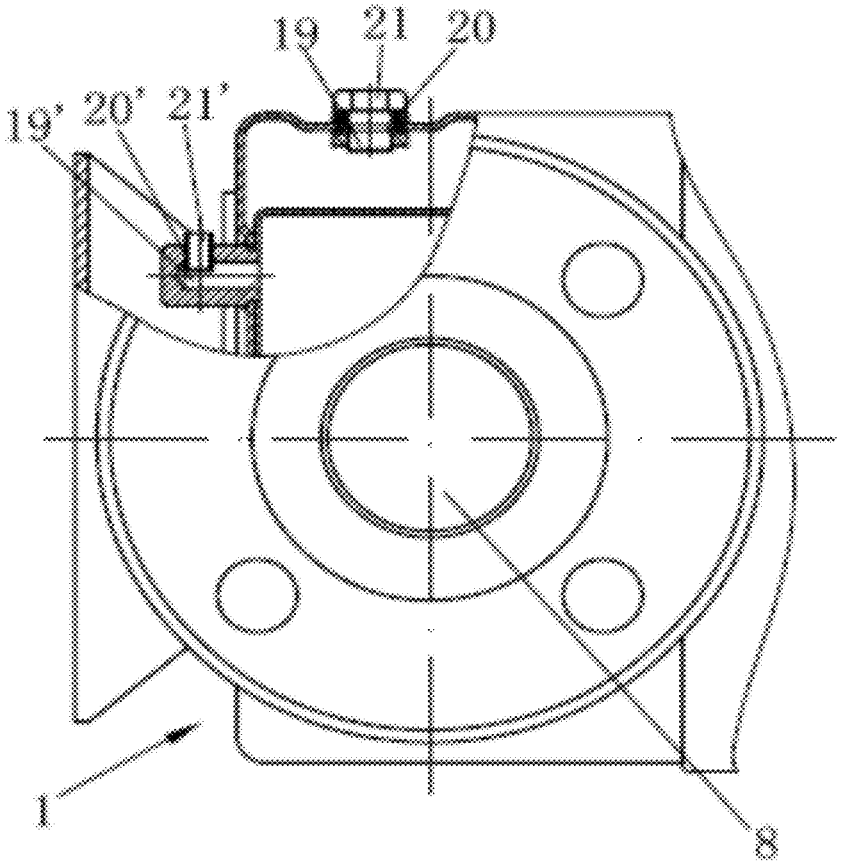
FIG. 6 illustrates a K direction of FIG. 4.

As shown in FIG. 5 and FIG. 6, the circumferential wall of the outer cylinder 10 is provided with a drain hole 19 of the outer cylinder, a seal ring 20 and a screw 21. The bottom of the outer cylinder is provided with a drain hole 19' of the inner cylinder, a seal ring 20' and a screw 21'.

All the overflow parts for the pipeline centrifugal pump in the embodiment of the present invention, e.g. the pump body, the outer cylinder, the inner cylinder, the flow guide part, the pedestal and the pump rear cover, are shaped via stamping and welding. Since all the overflow parts, e.g. the pedestal, the pump body, the flow guide part and the impeller, are shaped via stamping and welding, the pipeline centrifugal pump compared with the casting pump has following advantages, including the light and compact overall structure, greatly reduced weight and obvious effect on material saving. In addition, the reliability for the water pump in operation is significantly improved.

What is claimed is:

1. A pipeline pump shaped by stamping and welding, comprising a pump body, a pedestal connected to the bottom of the pump body, a pump rear cover and a motor mounted on an opening of the pump body, and an impeller installed inside the pump body, the impeller being installed on a pump shaft and driven for rotation by the motor, a water inlet pipe and a water outlet pipe being provided on the pump body, wherein the pump body consists of an inner cylinder and an outer cylinder both in barrel-shaped structure, the inner cylinder is connected to the water inlet pipe, and the outer cylinder is connected to the water outlet pipe, the inner cylinder is coaxially installed inside the outer cylinder by fixedly connecting the bottom of the inner cylinder with the bottom of the outer cylinder, an opening of the inner cylinder is lower than an opening of the outer cylinder, a flow guide part, the impeller, an exhaust part, and the pump rear cover mounted on the opening of the outer cylinder are coaxially arranged upwards in turn from the opening of the inner cylinder, the impeller is a centrifugal impeller with axial suction and radial discharge, the flow guide part is a disk-shaped structure shaped by integral stamping with the disk bottom being sealed with the opening of the inner cylinder, a water inlet which is correspondingly sealed with an inlet at a front end of the impeller is provided on the center of the disk bottom, the impeller is coaxially arranged inside the flow guide part with a shape of disk, a plurality of flow guide vanes which are corresponding to a radial exhaust port of the impeller are provided on a circumferential wall of the flow guide part, the flow guide part is shaped by integral stamping, the circumferential wall of the flow guide part is uniformly stamped into multiple sections, and the circumferential wall of each section is an arc-shaped guide vane increasing outward in radial direction along the same direction of the circumference, an outlet is axially downward formed by the radial difference between two adjacent guide vanes, and a disk rim is formed by outward stamping an opening of the flow guide part with a shape of disk, the impeller consists of a front cover plate, a back cover plate and a spiral vane clipped between the front cover plate and the back cover plate, the spiral vane with semi-twisting structure includes a twisted section on the end close to the water inlet and a section with non-twisted cylindrical structure on the end close to the exhaust port, twist rate is the biggest at the place close to the water inlet, and is gradually flat, the section close to the exhaust port is not twisted, and a connection between the two sections is smoothly transited, the twisted section of the vane is approximately a section of truncated cone, the section with non-twisted cylindrical structure of the vane is a section of truncated cylindrical lateral face and accounts for ⅕-½ of the total length of the vane, the width in axial direction of the twisted section of the vane is maximum at the water inlet, and gradually narrows to the width of the section with non-twisted cylindrical structure, and the structures of the two sections of the vane are internally tangent with each other.

2. The pipeline pump shaped by stamping and welding according to claim 1 wherein the twisted section of the vane is approximately a section of truncated cone, the section with non-twisted cylindrical structure of the vane is a section of truncated cylindrical lateral face and accounts for ⅕~½ of the total length of the vane, the width in axial direction of the twisted section of the vane is maximum at the water inlet, and gradually narrows to the width of the section with non-twisted cylindrical structure, and the structures of the two sections of the vane are internally tangent with each other.

3. The pipeline pump shaped by stamping and welding according to claim 2 wherein the twist rate of the vane is related to the specific speed of the pipeline pump, and the greater the specific speed is, the greater the twist rate is, the smaller the length of the section with non-twisted cylindrical structure is.

4. The pipeline pump shaped by stamping and welding according to claim 1 wherein the flow guide part is shaped by integral stamping, the circumferential wall of the flow guide part is uniformly stamped into a multiple sections, and the circumferential wall of each section is an arc-shaped guide vane increasing outward in radial direction along the same direction of the circumference, an outlet is axially downward formed by the radial difference between two adjacent guide vanes, and a disk rim is formed by outward stamping an opening of the flow guide part with a shape of disk.

5. The pipeline pump shaped by stamping and welding according to claim 4 wherein a boss club corresponding to the disk rim of the flow guide part is provided on the internal wall of the outer cylinder, the disk rim is placed on the boss club to support the flow guide part, and the axial distance between the boss club and the opening of the inner cylinder is equal to the axial depth of the flow guide part.

6. The pipeline pump shaped by stamping and welding according to claim 1 wherein, the front cover plate, the back cover plate and the spiral vane are all shaped by stamping of metal plates, which are combined by using laser welding, the front cover plate integrally consists of a front plate and an annular flange being formed by stamping process, a processing arc lies between the front plate and the annular flange, a seal ring sealing the disk bottom of the flow guide part and the inlet of the impeller is set on the front end of the annular flange, the seal ring matches with the front end of the annular flange, and a gap is set between the front plate of the front cover plate of the impeller and the seal ring.

7. The pipeline pump shaped by stamping and welding according to claim 1 wherein the exhaust part and the pump rear cover are simplified into one part which is stamped into a disk-shaped structure, the disk bottom encloses the impeller in the flow guide part, the center of the disk bottom bulges towards the inside of the disk to form a trumpet-shaped structure, and an exhaust vent, a seal ring and a bolt are provided on the circumferential wall of the trumpet-shaped structure.

8. The pipeline pump shaped by stamping and welding according to claim 1 wherein, the front cover plate, the back cover plate and the spiral vane are all shaped by stamping of metal plates, which are combined by using laser welding, the front cover plate integrally consistis of a front plate and an annular flange being formed by stamping process, a processing arc lies between the front plate and the annular flange, and a seal ring sealing the disk bottom of the flow guide part and the inlet of the impeller is set on the front end of the annular flange, the seal ring matches with the front end of the annular flange, and a gap is set between the front plate of the front cover plate of the impeller and the seal ring.

9. The pipeline pump shaped by stamping and welding according to claim 8 wherein, an inclination is formed by stamping process of the annular flange, and is in shape of a trumpet structure with gradually increased outside diameter from the inlet of the impeller to the inner, the diameter is the smallest in the section close to the water inlet of the flow guide part, and gradually becomes large in direction of the front plate, and finally connects with the front plate through processing arc, and the processing arc is tangent to the front plate and the annular flange respectively, the external diameter at the place where the processing arc is tangent to the front plate is greater than the internal diameter of the seal ring.

10. The pipeline pump shaped by stamping and welding according to claim 8 wherein drain holes, seal rings and screws for the outer cylinder and the inner cylinder are provided on the circumferential wall and the bottom of the outer cylinder respectively.

* * * * *